US006185969B1

(12) United States Patent
Jaubert

(10) Patent No.: US 6,185,969 B1
(45) Date of Patent: Feb. 13, 2001

(54) MACHINE FOR BENDING TUBES WITH SMALL DIAMETER

(75) Inventor: Philippe Jaubert, Cologne (FR)

(73) Assignee: Robolix, Cologne (FR)

( * ) Notice: Under 35 U.S.C. 154(b), the term of this patent shall be extended for 0 days.

(21) Appl. No.: 09/341,512

(22) PCT Filed: Jan. 9, 1998

(86) PCT No.: PCT/FR98/00033

§ 371 Date: Jul. 13, 1999

§ 102(e) Date: Jul. 13, 1999

(87) PCT Pub. No.: WO98/31484

PCT Pub. Date: Jul. 23, 1998

(30) Foreign Application Priority Data

Jan. 14, 1997 (FR) ..... 97-00437

(51) Int. Cl.[7] ..... B21D 7/08; B21D 7/02
(52) U.S. Cl. ..... 72/175; 72/173; 72/172
(58) Field of Search ..... 72/173, 175, 170, 72/169, 166, 307, 172

(56) References Cited

U.S. PATENT DOCUMENTS

| | | | | |
|---|---|---|---|---|
| 1,047,612 | * | 12/1912 | Brantigam | 72/173 |
| 1,567,107 | | 12/1925 | Bonn . | |
| 3,373,587 | * | 3/1968 | Shubin | 72/307 |
| 3,430,474 | * | 3/1969 | Mann | 72/173 |
| 4,653,301 | * | 3/1987 | Meliga | 72/175 |
| 5,197,320 | * | 3/1993 | Saeguss | 72/307 |

FOREIGN PATENT DOCUMENTS

| | | | |
|---|---|---|---|
| 0 319 400 | | 6/1989 | (EP) . |
| 0 538 207 | | 4/1993 | (EP) . |
| 2 554 021 | | 3/1985 | (FR) . |
| 4-127919 | * | 4/1992 | (JP) ..... 72/173 |

* cited by examiner

*Primary Examiner*—Daniel C. Crane
(74) *Attorney, Agent, or Firm*—Young & Thompson

(57) ABSTRACT

A machine for bending tubes (1) with small diameters, which are pre-cut and provided with connection systems at both ends. This machine comprises elements (5) for grasping the rear end of the tube (1), elements for entrainment of the grasping elements according to a longitudinal axis, and at least one bending head, comprising two forming rollers (7, 8), each of which has at least one peripheral groove, a folding finger (23), which is associated with a unit (24) for displacement according to a circular path which is centered on an axis (Y) at right-angles to the axis (X), and with a system (29) for displacement in translation according to an axis ($Y_1$) which is parallel to (Y), and guide units for the tube (1), which are disposed upstream and in the vicinity of the forming rollers (7, 8).

16 Claims, 4 Drawing Sheets

Y2
Y3
7
8
9
10
11
12
13
14
15
16
17
18
19
20
21
22
37a
56
57

MACHINE FOR BENDING TUBES WITH SMALL DIAMETER

CROSS REFERENCE TO RELATED APPLICATION

This is the national stage of international application PCT/FR98/00033 filed on Jan. 9, 1998, which designated the United States of America.

FIELD OF THE INVENTION

The invention relates to a machine for bending tubes with a small diameter, and in particular smaller than 10 mm, which are pre-cut and have connection systems at both ends. It also relates to a bending head, which is designed to equip a machine of this type.

BACKGROUND OF THE INVENTION

The bending machines which are used at present in order to bend tubes of this type conventionally comprise a frame, on which there are mounted bending means, which are provided with support surfaces, between which the tube to be bent passes, is clamped and then bent, the bending means being mounted on a bending head, which can pivot around an axis which is coaxial relative to the axis of the bending block. In addition, these bending machines generally comprise a guide rule, which is disposed upstream of the clamping jaw, and optionally a fold-remover component, which is disposed upstream of the bending block. Finally, they comprise means for longitudinal displacement of the tube relative to the frame.

The main disadvantage of these bending machines consists in the fact that they permit bending of the tubes only on a single side, either towards the right or towards the left. Furthermore, the positioning assembly of the clamping jaw, and the assembly for displacement of the rule, require a space which limits the geometry of the finished bent parts.

In order to eliminate the disadvantage relative to the single direction of bending, three main types of bending machines exist at present.

Firstly, a first solution consists of providing the bending machines with a numerically controlled gripper, which is designed to rotate the tube around its axis, in order to change the direction of bending. However, bending machines of this type have a first disadvantage, which is derived from the fact that during changes of the direction of bending, the movements of the tube generate so-called "whip" phenomena, which in particular can detract from the shape of the part produced.

A second solution consists of providing bending machines which are provided with means for entrainment in rotation of the bending head, which can make the latter rotate around the tube. However, at present, this solution is used exclusively with tubes which are packed onto bobbins, and not with tubes which are pre-cut, and which are previously provided with connections. It has been found that putting these connections into place is more complex and takes longer when it is carried out on products which are bent initially.

Finally, a third solution consists of providing bending machines which have a double bending head, which is associated with means for entrainment in rotation and/or in translation, which make it possible to bring the second bending head into the working position. However, this solution leads to production of bending machines which are relatively complex and large, and thus have a high cost price.

In addition, the change of direction of bending makes it necessary to displace the bending heads, and this operation requires a relatively long period of time, which detracts from the productivity of the machine.

OBJECT OF THE INVENTION

The object of the present invention is to eliminate all the aforementioned disadvantages of the present bending machines, and its main objective is to provide a machine which has a very simple design, and therefore a relatively low cost price and a small size, thus making it possible to produce at a very fast pace parts which have a complex geometry, which cannot be produced by means of the present machines as previously described, using straight tubes which have a small diameter, are pre-cut, and are provided with connection systems at both ends.

A further object of the invention is to produce at a fast pace parts which comprise coils.

A further object of the invention is to provide at a fast pace parts which comprise sheathed portions.

A further object of the invention is to provide at a fast pace parts which comprise a final, very short, straight end portion.

SUMMARY OF THE INVENTION

For this purpose, the invention relates to a bending machine comprising a frame, on which there is mounted at least one bending head, and means for longitudinal displacement of the tube relative to the frame, according to an axis (X). According to the invention, this bending machine is characterised in that:

- the longitudinal displacement means comprise means for grasping the rear end of the tube, and means for entrainment of the grasping means along the longitudinal axis (X);
- each bending head comprises:
  - two forming rollers, each of which has at least one peripheral groove with a semi-circular cross-section, which, in a coupled position of the rollers, is designed to form a guide duct, which has a neck with a diameter which is substantially larger than that of the tube;
  - means for relative displacement of the forming rollers, which can position the rollers either in their coupled position, or in a so-called opening position, which can permit passage of the tube according to an axis which is perpendicular to the axis (X);
  - a folding finger which is disposed upstream, and in the vicinity of the forming rollers;
  - means for displacement of the folding finger according to a circular path which is centred on an axis (Y) at rightangles to the axis (X);
  - means for displacement in translation of the folding finger according to an axis (Y,) which is parallel to (Y);
  - guide units for the tube, which are disposed on both sides of the axis (X), such as to come into contact with the tube upstream, and in the vicinity of the forming rollers, the guide units being designed to retract transversely under the effect of a longitudinal force which is exerted by the grasping means.

Firstly, a bending machine of this type is designed in order to permit bending of pre-cut tubes, which are provided with connection systems at both ends. In fact, firstly, the grasping means are designed to assure maintenance of the rear end of the tube, provided with its connection system, and secondly, the possibility of "opening" of the guide rollers makes it possible to pass through the straight pre-cut tube, provided with its connection systems, either manually, or by means of a loading system.

In addition, a bending machine of this type permits production of parts which have complex and varied geometries, since it makes it possible to provide:

bending by forming on the rollers, by displacing the folding finger according to its circular path which is centred on the axis (Y); and variable radii, which are larger than the radii of the forming rollers, in particular in order to obtain coils, by placing the folding finger in a fixed position along its circular path, and by thrusting the tube by means of means for entrainment in translation of the grasping means. It should also be noted that during bending operations of this type, the guide units of the tube, which are disposed upstream of the rollers, play an essential part, since by maintaining this tube in position, they prevent any deformation of the portion of tube which extends between the grasping means and the rollers. In addition, the retractable nature of these guide units makes it possible to displace the grasping means until the latter come into contact with the rollers, and consequently to carry out bending of virtually the entire length of the tubes.

In addition, it is also essential to note that the fact that the tube is guided inside the grooves of the forming rollers makes it possible to control suitably the ovalisation of the tubes with a small diameter, during operations of bending of the latter.

The bending machine according to the invention also has the advantage that it makes it possible to bend the tubes in both directions very easily, since the only operations to be carried out in order to change the bending consist of combining displacements in translation, and a displacement according to the circular path, of the folding finger. Thus, this bending machine permits very fast paces of folding, and in addition, owing to its simple design (only the folding finger needs to be displaced), it provides a bending head with a small size.

According to another characteristic of the invention, the bending rollers comprise two superimposed grooves, which have cross-sections designed to form two guide ducts, which have necks with different diameters. In addition, means for displacement in translation of the forming rollers, respectively according to an axis ($Y_2$), ($Y_3$) parallel to (Y), are designed to position the latter such that one or the other of their grooves is centred relative to the longitudinal axis (X).

Without requiring any adjustment, this arrangement makes it possible to bend a tube which has two different diameters, such as a tube of which specific portions of lengths are sheathed, and/or to bend a tube which has different radii of bending.

According to a further characteristic of the invention, the bending machine comprises means for displacement in translation of the folding finger, which can displace the latter radially relative to the axis (Y). The fact of being able to displace the folding finger relative to the forming rollers makes it possible to vary the length of the straight portions of tube, between two bending operations, and in particular to produce straight portions of tube which have a very short length.

The bending machine additionally preferably comprises a rule, which is disposed upstream of the forming rollers, in contact with the latter, and has a support surface which forms a support for the tube, the rule being associated with displacement means which are designed to bring the rule into a retracted position, which makes it possible to advance the grasping means into contact with the forming rollers. The purpose of this rule is to ensure that the tube is maintained immediately upstream of the rollers, and thus makes it possible to obtain the correct angle of bending. In addition, the retractable nature of the rule makes it possible to displace the grasping means until the latter come into contact with the rollers, where they replace the rule in ensuring that the tube is maintained in position.

In addition, advantageously, this rule is in the shape of a U, the means for displacement of the said rule consisting of pivoting means, which can make the rule pivot around an axis which is at right-angles to the axes (X) and (Y).

According to another characteristic of the invention, the means for relative displacement of the forming rollers comprise means for entrainment in rotation of each of these rollers around the axes ($Y_2$), ($Y_3$), the rollers having a non-circular shape, which is designed to release a space when the rollers are rotated from their coupled position. This method of relative displacement of the rollers has the advantage that it provides optimisation of the size of the bending head, since the translation of the rollers, which is designed to use one or the other of their grooves, as well as their relative displacement, take place around single axes ($Y_2$), ($Y_3$).

In addition, according to this embodiment, it is possible to use rollers with different sizes, which makes it possible to carry out bending of different radii, and/or bending of tubes with different diameters. For this purpose, it is sufficient to produce these rollers such that their axes of rotation are eccentric by an adequate value.

According to a preferred embodiment, each forming roller is mounted on a shaft, which extends respectively according to the axis ($Y_2$, $Y_3$), the means for entrainment in rotation of the rollers comprising two pinions, which are each mounted on one of the shafts, a rack, which is provided with two toothed lateral surfaces, which are each designed to engage with a pinion, and means for entrainment of the rack according to a longitudinal axis ($X_1$), which is parallel to the axis (X).

In addition, the shaft of each roller advantageously consists of a rod of a jack, which is disposed such as to give rise to displacements in translation of the roller, respectively according to the axis ($Y_2$), ($Y_3$).

According to a further characteristic of the invention, the bending machine comprises a support unit which is retractable laterally relatively to the axis (X), which is designed to be positioned in contact with a generatrix of the tube, diametrically opposite that which is supported on the support surface of the rule, upstream and in the vicinity of the forming rollers.

For bending machines which make it possible in a conventional manner to rotate the bending head around the tube, in order to carry out multi-directional bending, this support unit serves the purpose of maintaining the tube in position, when, during opening of the rollers, the bending head is disposed such that the tube is beneath the rule.

In addition, this support unit advantageously consists of a cable, which extends inside a sheath, one of the ends of this cable being integral with a rod of a jack, which is designed to make the cable slide inside the sheath, and the other end of this cable extends according to a plane which is at right-angles to the planes (X) and (Y), such as to be positioned in contact with the tube during displacement of the jack.

According to another characteristic of the invention, the bending machine comprises two support plates, which have a convex support surface, and are disposed at rightangles relative to the axis (X), on both sides of the latter, upstream of the forming rollers, the support plates being offset relative to the forming rollers, according to an axis which is parallel to the axis (Y), and disposed such that during the formation of coils, after being bent, the tube is displaced on the support surface of one of the support plates.

Support plates of this type have the advantage that they make it possible to form coils which have a specific pitch.

In addition, advantageously, adjustment means permit modification of the position of the support plates along an axis which is parallel to the axis (Y), and thus make it possible to modify the pitch of the coils.

According to a further characteristic of the invention, the bending machine comprises:

two detection cells, which are disposed symmetrically on both sides of the axis (X), upstream of the forming rollers, such that, according to the direction of bending, the beam of one of the cells is intersected by the end of the tube, during the formation of coils; and numerical control means, which are programmed to calculate the length paid out for the formation of each revolution of a coil, to compare this value with a value stored, which is representative of the theoretical length paid out which is necessary for formation of a revolution of a coil, and, according to the result of this comparison, to command displacement of the folding finger along its circular path, for formation of the revolution of the following coil, such that the total length paid out for formation of a coil is strictly identical for a series of identical products.

During production of a series of identical products, these arrangements make it possible to use a fixed length paid out for formation of the coils, and thus to form products, the angles of the intake and outlet ends of the coils of which are always identical.

In addition, the guide units of the tube are preferably disposed each on the end of an arm which is mounted such as to pivot relative to the frame, and is associated with resilient means, which can maintain the arm in a position which is inclined rearwards relative to the direction of displacement of the tube.

This design makes it possible to obtain self-locking of the guide units during displacement of the tube, whilst permitting retraction, by pivoting, of the guide units, under the effect of the force exerted by the grasping means.

The invention includes a bending head, which comprises:

two forming rollers, each of which has at least one peripheral groove with a semi-circular cross-section, which, in a coupled position of the rollers, is designed to form a guide duct which is oriented according to an axis (X), and has a neck with a diameter which is substantially larger than that of the tube;

means for relative displacement of the forming rollers, which can position the rollers either in their coupled position, or in a so-called opening position, which can permit passage of the tube according to an axis which is perpendicular to the axis (X);

a folding finger, which is disposed upstream, and in the vicinity of the forming rollers;

means for displacement of the folding finger according to a circular path, which is centred on an axis (Y), which is at right-angles to the axis (X);

means for displacement in translation of the folding finger, according to an axis (Y,) which is parallel to (Y); and guide units for the tube, which are disposed on both sides of the axis (X), such as to come into contact with the tube, upstream and in the vicinity of the forming rollers, the guide units being designed to retract transversely under the effect of a longitudinal force exerted by the grasping means.

It also includes a bending head, which has any one of the following characteristics.

BRIEF DESCRIPTION OF THE DRAWINGS

Other characteristics, objects and advantages of the 5 invention will become apparent from the following detailed description, provided with reference to the attached drawings, which show a preferred embodiment, by way of non-limiting example. In these drawings, which are an integral part of the present description.

DETAILED DESCRIPTION OF THE INVENTION

Figure 1:
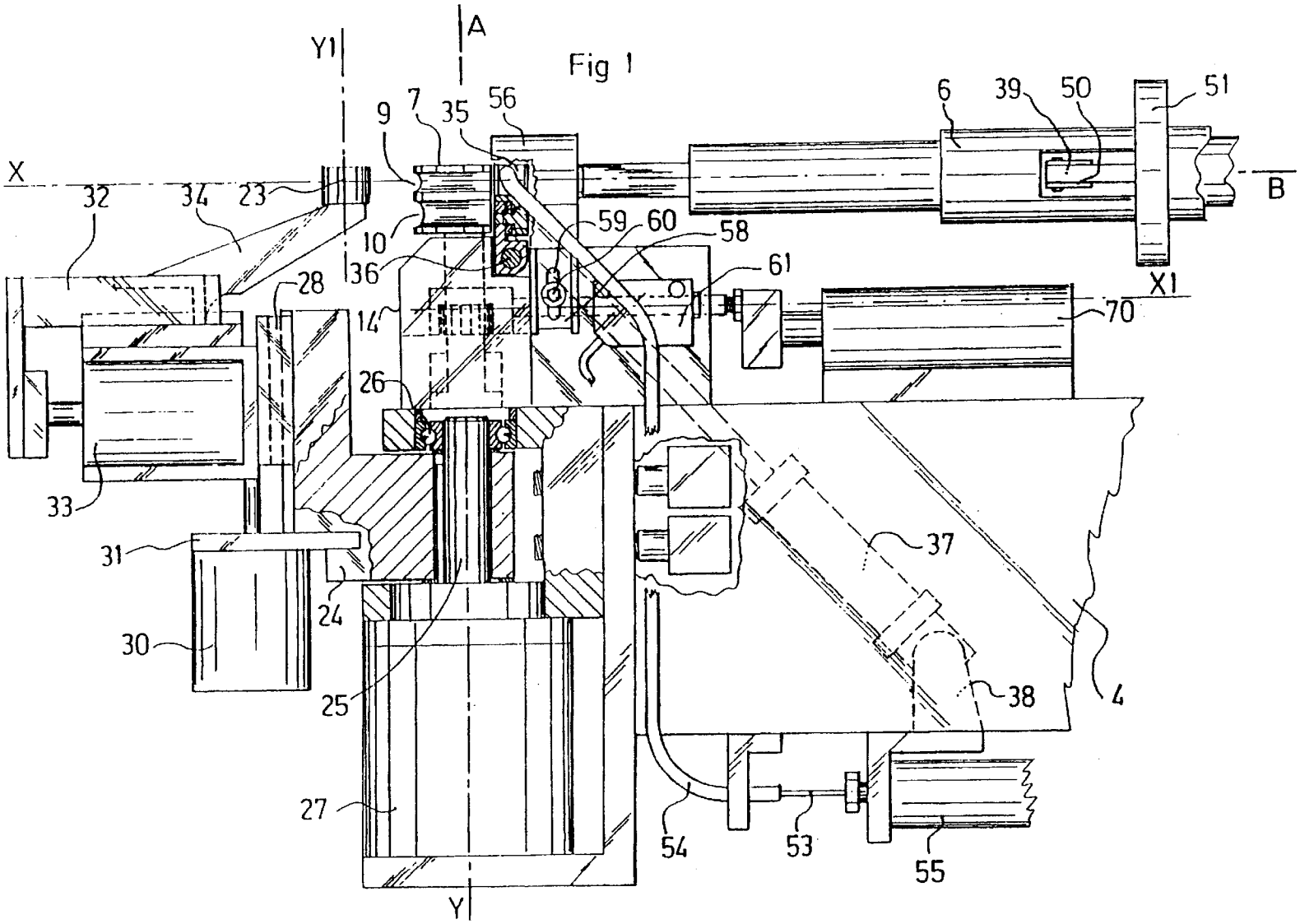
FIG. 1 is a lateral view partially in longitudinal cross-section, through an axial plane, of a bending machine according to the invention.
Figure 2:
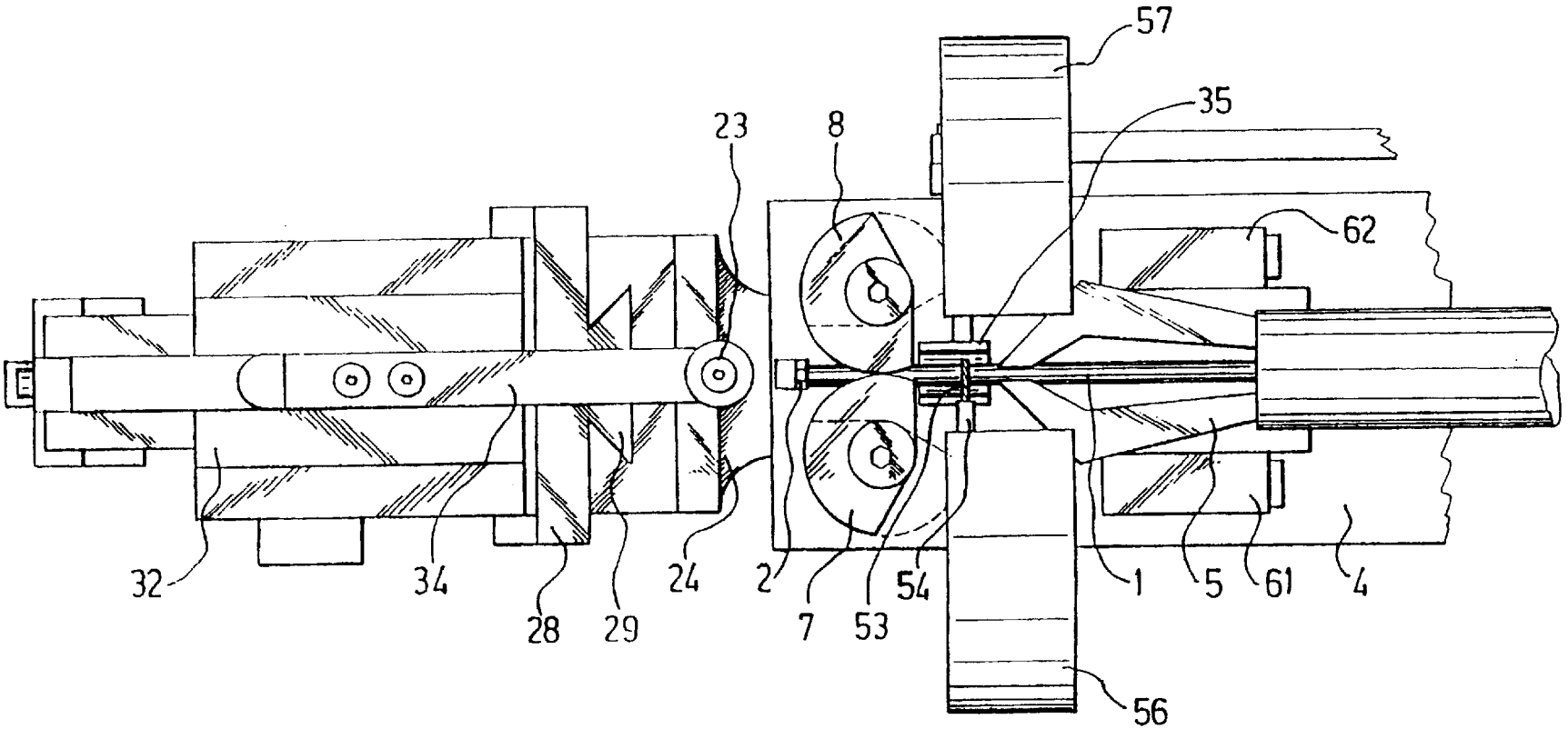
FIG. 2 is a plan view of this bending machine.
Figure 3:
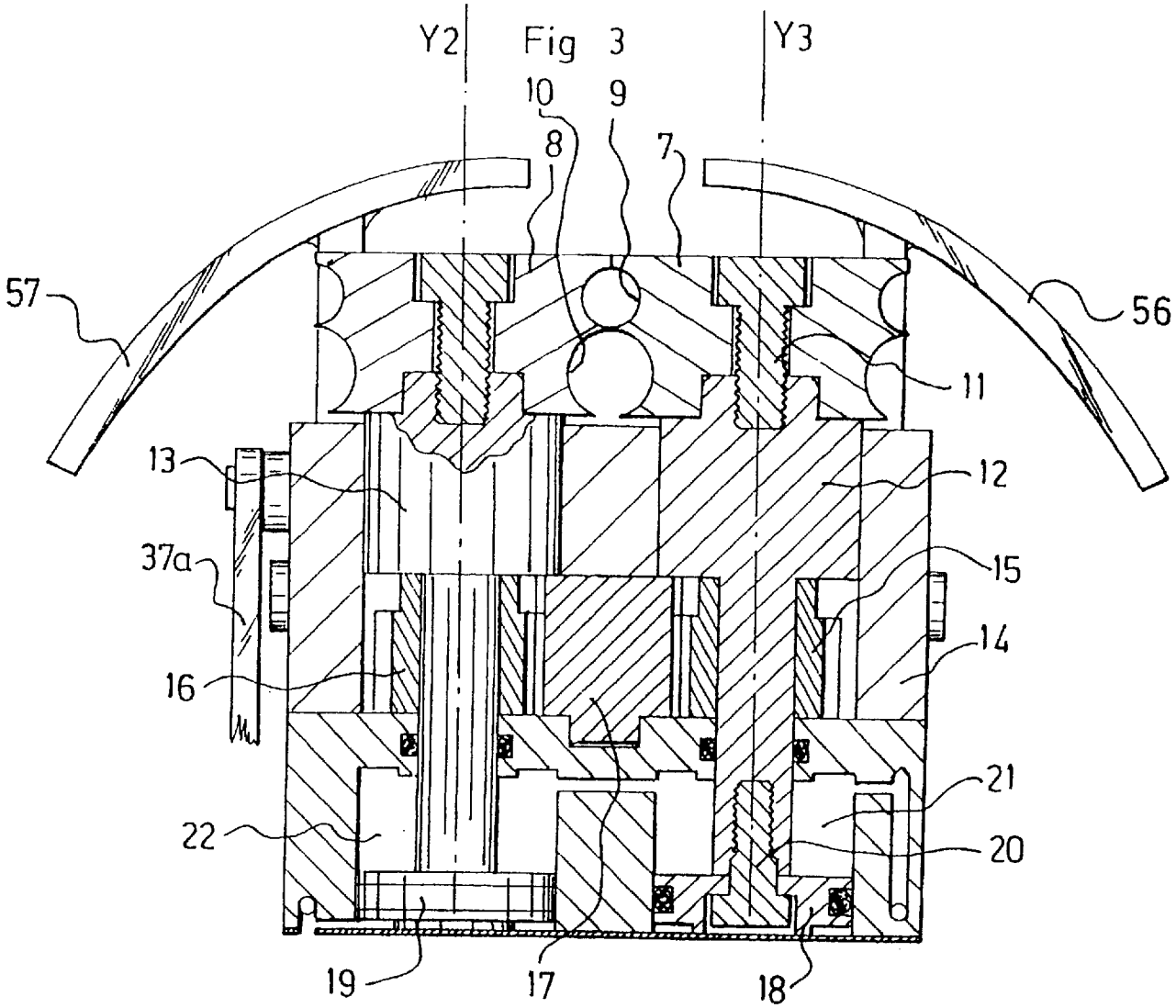
FIG. 3 is a transverse cross-section through a vertical plane A.

The bending machine which is shown by way of example in FIGS. 1 to 3 is designed to provide bending of tubes 1 with a small diameter, such as a diameter of 4.75 mm, which are pre-cut to a pre-determined length, and are provided with connections 2, 3 at both ends.

This bending machine firstly comprises a frame 4, on which there is mounted the above-described bending head, and a gripper 5, which can clamp the rear end of the tube 1 downstream of the connection 3, the gripper being accommodated inside a cylindrical duct 6 and associated with conventional entrainment means (not shown), which can displace the gripper longitudinally according to an axis (X), relative to the frame 4.

In addition, this bending machine can be provided either with means for entrainment in rotation of the gripper 5 around the axis (X), or means for entrainment in rotation of the frame 4 around the gripper 5, in order to provide multi-directional bending. The above-described bending heads can also be provided on a bending machine as described in patent FR 2 554 021.

However, for the purpose of simplification, the above-described bending machine is described in a fixed position as shown in the Figures, making it possible to bend the tube 1 either to the right or to the left, by forming in a horizontal plane, and to form coils with a vertical revolution axis.

Firstly, the bending head comprises two forming rollers 7, 8, which have a generally semi-circular shape (as shown in the Figures), or a semi-elliptical shape, and are each provided with two superimposed grooves 9, 10, with semi-circular cross-sections, making it possible to guide tubes with different diameters, such as a tube 1 with a specific diameter, and the same tube 1 covered with a sheath.

Each of these forming rollers 7, 8 is mounted on the upper end of a vertical rotation shaft 12, 13, with which it is rendered integral by means of a screw 11, each of the said shafts being accommodated and mounted such as to rotate inside bores provided in a housing 14.

The means for entrainment in rotation of these shafts 12, 13 around their respective axes of revolution ($Y_2$, $Y_3$), comprise, for each of the shafts, a pinion 15, 16, which is mounted around, and is integral with the latter. They also comprise a rack 17, which extends horizontally, and is provided with two toothed lateral surfaces, which are each designed to engage with one of the pinions 15, 16.

Finally, the means for entrainment in rotation of the shafts 12, 13 comprise a jack 70 which is disposed horizontally, the body of which is integral with the frame 4, and the rod of which is integral with the rack 17, such as to give rise to displacements of the latter, according to a horizontal axis ($X_1$).

These means for entrainment in rotation make it possible to pivot the forming rollers 7, 8 by an angle of 90° between:

- a coupled position of the rollers, shown in the Figures, in which the latter provide guiding of the tube 1; and
- an "opening" position of the rollers (shown as a broken line in FIG. 2), in which the flat truncated surfaces of the latter are opposite one another, and in particular permit positioning and unloading of the tube 1.

In addition, it should be noted that these means for entrainment in rotation of the shafts 12, 13, and thus of the forming rollers 7, 8, make it possible to use rollers which have a size larger than those shown in the Figures, in order to obtain different forming radii. For this purpose, it is sufficient simply for the axis of rotation of these rollers to be eccentric adequately relative to the axis of symmetry of the rollers.

The forming rollers 7, 8 are also associated with means of entrainment in translation respectively according to the axes ($Y_2$, $Y_3$) which can bring one or the other groove 9, 10 into the axis of the plane of displacement of the tube 1.

For each shaft 12, 13, these means of entrainment in translation comprise a piston 18, 19, which is rendered integral, beneath the lower end of the shaft, by means of a screw such as 20, each of the pistons extending in a jack chamber 21, 22, which is provided in the housing 14, and has conventional fluid intakes, making it possible to give rise to displacements of the pistons.

The bending head additionally comprises a folding finger 23, which consists of a roller with a cylindrical shape, which is disposed downstream of the forming rollers 7, 8, and is associated with:

- means for displacement of the folding finger, according to a circular path which is centred on an axis (Y), which is coplanar relative to the axes ($Y_2$), ($Y_3$) and perpendicular to the axis (X);
- means for displacement in translation of the folding finger according to an axis ($Y_1$) which is parallel to (Y); and
- means for displacement in translation of the folding finger, according to axes which are radial relative to the axis (Y).

For this purpose, the bending machine firstly comprises a rotary block 24, which is integral with a drive shaft 25, which extends according to the axis (Y) and is disposed beneath the housing 14, the shaft being mounted such as to rotate relative to the frame 4, by means of bearings such as 26, and being entrained in rotation by a gear motor 27, which is coaxial relative to the latter.

For the purpose of the displacements of the folding finger 23 according to the axis ($Y_1$), the bending machine comprises a first carriage 28, which is mounted on the rotary block 24, by means of a system for guiding in translation 29, which is in the shape of a dovetail, and is integral with the rod of a jack 30, which is disposed vertically, the body of which is supported by a horizontal plate 31 secured to the rotary block 24.

Finally, for the purpose of the displacements of the folding finger 23, according to axes which are radial relative to the axis (Y), the bending machine comprises a second carriage 32, which is mounted on the first carriage 28, by means of a guide system in the shape of a dovetail, and is rendered integral with the rod of a jack 33 which is disposed horizontally, the body of which is supported by the first carriage 28.

The folding finger 23 is supported by this second carriage 32, and is disposed at right-angles to the end of an inclined arm 34, which extends above the second carriage, in the direction of the forming rollers 7, 8.

The bending machine additionally comprises first and second means for guiding of the tube 1, which are designed to prevent any deformation of the tube upstream of the forming rollers 7, 8.

The first guide means consist of a rule 35, which is disposed immediately upstream of the forming rollers 7, 8, and has a support surface, which forms a support for the tube 1. This rule 35 consists of a U-shaped bracket, which is centred on the axis (X), and is mounted on a rule-holder part 36, which is articulated relative to the frame 4, around a horizontal axis which is at right-angles to the axis (X), such as to permit retraction of the rule 35, by pivoting of the latter, and to bring the gripper 6 into contact with the forming rollers 7, 8.

The means for pivoting of this rule 35 consist of a jack 37, which extends according to an axis which is inclined substantially by 45° relative to the axis (X), the rod of which is articulated on the rule, and the body of which is articulated inside a cover 38, which is integral with the frame 4.

Figure 4:
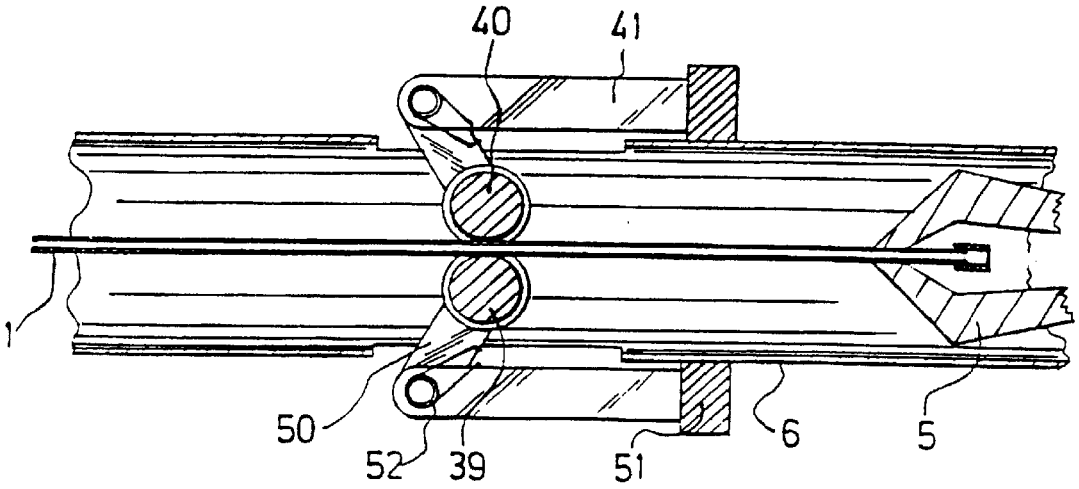
FIG. 4 is a partial longitudinal cross-section through a plane B, on an enlarged scale, of the retractable guide means of this bending machine.

As shown in FIG. 4, the second guide means comprise two small wheels 39, 40, each of which is supported by an arm such as 50, which extends through an aperture provided in the guide duct 6 of the gripper 5, the arms being mounted such as to pivot, each on a tab such as 41, which is integral with a flange 51, mounted on the duct 6.

In addition, coiled springs such as 52, which are disposed around the rotational shaft of the arms 50, and are integral with the tabs 41 and the arms, are designed to maintain the latter, in the absence of stress, in a position in which they are inclined rearwards relative to the direction of displacement of the tube 1.

Thus, the small wheels 39, 40 maintain and guide the tube 1 during longitudinal displacement of the latter, but retract transversely under the effect of the pressure exerted by the gripper 5 when the latter comes into contact with the small wheels.

The bending machine additionally comprises a support unit, which is designed to provide support for the tube 1, when the frame 4 is pivoted by 180° relative to the position shown in the Figures, and during "opening" of the forming rollers 7, 8.

This support unit consists of a cable 53, which extends inside a sheath 54, one of the ends of this cable being integral with the rod of a jack 55, which is designed to enable the cable to slide inside the sheath, and the other end being disposed such as to be positioned transversely beneath the tube 1 (in the aforementioned position of the frame 4), during use of the jack 55.

The bending machine additionally comprises two support plates 56, 57, which are designed to make it possible to determine the pitch of the coils, during formation of the latter.

For this purpose, these two support plates 56, 57 consist of two curved plates, which have a convex upper surface, and are disposed at right-angles relative to the axis (X), on both sides of the latter, upstream of the forming rollers 7, 8, and offset upwards relative to the axis (X).

In addition, these support plates 56, 57 are supported by vertical tabs such as 59, which contain an oblong hole with a large vertical axis, and are rendered integral with the frame 4 by means of screws such as 60, which make it possible to regulate the height position of the support plates, and thus to modify the pitch of the coils.

Figure 5:
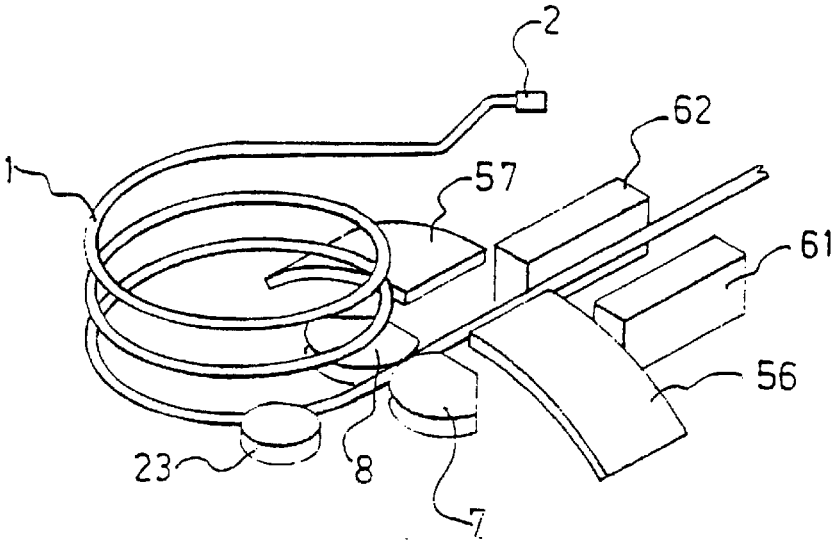
FIG. 5 is a schematic perspective view of this bending machine, during the formation of coils.

As shown in FIG. 5, during the formation of coils, the tube 1 is displaced on the upper surface of one of the support plates 56, 57, which thus determines the pitch of this coil, which is adjustable according to the height position of the latter.

Finally, the bending machine comprises two cells 61, 62, which are disposed upstream of the support plates 56, 57, symmetrically on both sides of the axis (X), such that the beam of one of the cells is intersected by the final end of the tube 1, during the formation of coils.

These two cells 61, 62, which are associated with a numerically controlled bending machine, serve the purpose, during production of a series of identical products, of using a fixed length paid out for the formation of the coils, and forming coils, the angle of the intake and outlet ends of which are always identical.

For this purpose, the bending machine is programmed, during each revolution of a coil, in order to:

measure the length paid out for formation of this revolution, by means of detection of the final end of the tube 1;

on the basis of this length paid out, to calculate the radius of this revolution of a coil;

when this radius differs from the pre-determined theoretical radius, to correct the radius of revolution of the following coil, by commanding displacement of the folding finger 23, by actuation of the gear motor 27;

all such that the length paid out for formation of the coil is always strictly identical, by means of production of an acceptable coil which has slightly differing radii.

What is claimed is:

1. A bending machine for bending tubes with small diameters, which are pre-cut such as to have a predetermined length, and are provided with connection systems at both ends, the bending machine comprising: a frame, on which there is mounted at least one bending head, and means for longitudinal displacement of the tube relative to the frame along a longitudinal axis (X), wherein:

the means for longitudinal displacement comprise means for grasping the rear end of the tube, and means for entrainment of the grasping means along the longitudinal axis (X);

each bending head comprises:

two forming rollers, each of which has at least one peripheral groove with a semi-circular cross-section, which, in a coupled position of the rollers, is designed to form a guide duct having a neck with a diameter which is substantially larger than that of the tube;

means for relative displacement of the forming rollers, which can position the rollers either in their coupled position, or in an open position which permits passage of the tube along a first axis which is perpendicular to the longitudinal axis (X);

a folding finger disposed downstream and in the vicinity of the forming rollers;

means for displacement of the folding finger along a circular path which is centered on a second axis (Y) at right angle to the longitudinal axis (X);

means for displacement in translation of the folding finger along a third axis ($Y_1$) which is parallel to the second axis (Y); and guide units for guiding the tube, disposed on both sides of the longitudinal axis (X), such as to come into contact with the tube upstream and in the vicinity of the forming rollers; said guide units being structured and arranged to retract transversely, under the effect of a longitudinal force exerted by the grasping means.

2. The bending machine according to claim 1, wherein:

the forming rollers comprise two superimposed grooves having cross-sections designed to form two guide ducts, which have necks with different diameters;

means for displacement in translation of the forming rollers according to an axis ($Y_2$), ($Y_3$), parallel to the second axis (Y), designed to position the rollers such that one or the other of their grooves is centered relative to the longitudinal axis (X).

3. The bending machine according to claim 1, further comprising additional means for displacement in translation of the folding finger, which can displace the finger radially relative to the second axis (Y).

4. The bending machine according to claim 1, further comprising a rule disposed upstream of the forming rollers in contact therewith, and having a support surface which forms a support for the tube; said rule being associated with means for displacement, which are designed to bring the rule into a retracted position, thus making it possible to advance the grasping means into contact with the forming rollers.

5. The bending machine according to claim 4, wherein the rule is in the shape of a "U", and the means for displacement of the rule comprise pivoting means, which can make the rule pivot around an axis at right-angles to the longitudinal axis (X) and the second axis (Y).

6. The bending machine according to claim 2, wherein the means for relative displacement of the forming rollers comprise means for entrainment in rotation of each of these rollers around axes ($Y_2$), ($Y_3$); said rollers having a non-circular shape, which is designed to release a space when the rollers are rotated from their coupled position.

7. The bending machine according to claim 6, wherein each forming roller has a generally semi-circular or semi-elliptical shape.

8. The bending machine according to claim 6, wherein each forming roller is mounted on a shaft, which extends respectively according to the axis ($Y_2$), ($Y_3$); the means for entrainment in rotation of the rollers comprising two pinions, each of which is mounted on one of the shafts, a rack, which his provided with two toothed lateral surfaces, each of which is designed to engage with a pinion; and means for entrainment of the rack along a longitudinal axis ($X_1$) which is parallel to the longitudinal axis (X).

9. The bending machine according to claim 8, wherein the shaft of each forming roller comprises a rod a jack, which is designed to displace in translation the roller respectively according to the axes ($Y_2$) ($Y_3$).

10. The bending machine according to claim 4, further comprising a support unit, which is retractable laterally relative to the longitudinal axis (X) and is designed to be positioned in contact with a generatrix of the tube, diametrically opposite that which is supported on the support surface of the rule, upstream and in the vicinity of the forming rollers.

11. The bending machine according to claim 10, wherein the support unit comprises a cable which extends inside a sheath, a first end of said cable being integral with a rod a jack designed to make the cable slide inside the sheath, and a second end of said cable extending according to a plane at right angles to the planes (X) and (Y), such as to be positioned in contact with the tube, during displacement of the jack.

12. The bending machine according to claim 1, further comprising two support plates, which have a convex support surface, and are disposed at right angles relative to the longitudinal axis (X) and on both sides thereof upstream of the forming rollers; said support plates being offset relative to the forming rollers, along an axis which is parallel to the second axis (Y), such that during formation of coils, after being bent, the tube is displaced on the support surface of one of the support plates.

13. The bending machine according to claim 12, further comprising means for adjustment of the position of the support plates along an axis which is parallel to the second axis (Y).

14. The bending machine according to claim 1, wherein the guide units for the tube are each disposed on an end of an arm, which is mounted such as to pivot relative to the frame, and is associated with resilient means which can maintain the arm in a position which is inclined rearwards, relative to the direction of displacement of the tube.

15. The bending machine according to claim 12, further comprising:

two detection cells disposed symmetrically on both parts of the longitudinal axis (X), upstream of the forming rollers, such that according to the direction of bending, a beam of one of said cells is intersected by the end of the tube during the formation of the coils;

numerical control means designed to calculate the length paid out for formation of each revolution of a coil, to compare this value with a value stored, which is representative of the theoretical paid out length necessary for formation of a revolution of a coil, and according to the result of this comparison, to command displacement of the folding finger along its circular path, in order to form the following revolution of a coil, such that the total length paid out for formation of a coil is always strictly identical for a series of identical products.

16. A bending head for a machine for bending pre-cut tubes with a small diameter, which are provided with connection systems at both ends, the bending head comprising:

two forming rollers each of which having at least one peripheral groove with a semi-circular cross-section, which, in a coupled position of the rollers, is designed to form a guide duct which is centered according to a longitudinal axis (X), and has a neck with a diameter which is substantially larger than that of the tube;

means for relative displacement of the forming rollers, which can position the roller either in their coupled position, or in an open position which permits passage of the tube along a first axis which is perpendicular to the longitudinal axis (X);

a folding finger disposed upstream and in the vicinity of the forming rollers;

means for displacement of the folding finger along a circular path which is centered on a second axis (Y) at right angles to the longitudinal axis (X);

means for displacement in translation of the folding finger along a third axis ($Y_1$) which is parallel to the second axis (Y); and guide units for guiding the tube disposed on both sides of the longitudinal axis (X), such as to come into contact with the tube upstream and in the vicinity of the forming rollers; said guide units being structured and arranged to retract transversely under the effect of a longitudinal force exerted by a grasping means.

* * * * *